US009988887B2

(12) United States Patent
Meyer et al.

(10) Patent No.: US 9,988,887 B2
(45) Date of Patent: Jun. 5, 2018

(54) METAL BELLOWS EQUALIZER CAPACITY MONITORING SYSTEM

(71) Applicant: Baker Hughes Incorporated, Houston, TX (US)

(72) Inventors: Aron M. Meyer, Pryor, OK (US); David Tanner, Broken Arrow, OK (US); Arturo Luis Poretti, Claremore, OK (US); Ryan P. Semple, Owasso, OK (US); Kevin J. Gilmore, Claremore, OK (US)

(73) Assignee: BAKER HUGHES, A GE COMPANY, LLC

( * ) Notice: Subject to any disclaimer, the term of this patent is extended or adjusted under 35 U.S.C. 154(b) by 377 days.

(21) Appl. No.: 14/707,277

(22) Filed: May 8, 2015

(65) Prior Publication Data

US 2015/0322770 A1 Nov. 12, 2015

Related U.S. Application Data

(60) Provisional application No. 62/018,803, filed on Jun. 30, 2014, provisional application No. 61/990,292, filed on May 8, 2014, provisional application No. 62/003,660, filed on May 28, 2014.

(51) Int. Cl.

| | |
|---|---|
| ***E21B 47/00*** | (2012.01) |
| ***E21B 43/12*** | (2006.01) |
| ***F04B 43/00*** | (2006.01) |
| ***F04B 43/04*** | (2006.01) |
| ***F04B 47/00*** | (2006.01) |
| ***F04B 53/16*** | (2006.01) |
| ***F04B 47/06*** | (2006.01) |

(52) U.S. Cl.
CPC ..... *E21B 43/128* (2013.01); *E21B 47/0007* (2013.01); *F04B 43/0081* (2013.01); *F04B 43/04* (2013.01); *F04B 47/00* (2013.01); *F04B 47/06* (2013.01); *F04B 53/16* (2013.01)

(58) Field of Classification Search
CPC .... F16J 3/04; F16J 3/048; F04B 35/04; F04B 43/0081; F04B 43/43; F04B 43/04; F04B 47/00; F04B 47/06; F04B 53/16; F04D 13/062; E21B 43/128
USPC ..... 92/5 R, 37, 44; 91/1; 417/414, 413.1
See application file for complete search history.

(56) References Cited

U.S. PATENT DOCUMENTS

| | | | | |
|---|---|---|---|---|
| 3,184,965 A * | 5/1965 | Noik | E21B 47/00 73/152.51 |
| 4,462,765 A | 7/1984 | Rodkin et al. | |
| 4,492,523 A * | 1/1985 | Knox | F04B 47/06 417/13 |
| 5,224,841 A | 7/1993 | Thomson et al. | |
| 6,070,337 A * | 6/2000 | Wallrafen | G01B 7/003 324/207.11 |

(Continued)

FOREIGN PATENT DOCUMENTS

| | | | |
|---|---|---|---|
| EP | 1600120 | 11/2005 | |
| WO | 89/07236 | 8/1989 | |
| WO | WO 2013098322 A2 * | 7/2013 | F15B 1/24 |

*Primary Examiner* — Michael Leslie
*Assistant Examiner* — Richard Drake
(74) *Attorney, Agent, or Firm* — Shawn Hunter

(57) ABSTRACT

A bellows position monitoring arrangement to determine the axial position of a bellows assembly within the outer housing of a seal section or equalizer. The position can be correlated to an amount of motor oil being retained within the bellows assembly.

8 Claims, 4 Drawing Sheets

(56) References Cited

U.S. PATENT DOCUMENTS 6,167,965 B1 1/2001 Bearden et al.
6,321,590 B1 * 11/2001 Matsumura ..... G01M 3/2853 73/40
6,422,822 B1 7/2002 Holmes
6,484,620 B2 * 11/2002 Arshad ..... F02B 77/08 91/1
6,542,350 B1 4/2003 Rogers
7,104,331 B2 9/2006 Bussear et al.
7,377,333 B1 * 5/2008 Sugiura ..... E21B 7/06 166/66.5
7,552,671 B2 * 6/2009 Neumann ..... G01D 5/34761 91/1
7,588,082 B2 * 9/2009 Lasater ..... E21B 47/024 166/255.1
7,624,800 B2 12/2009 Jamieson et al.
7,665,975 B2 2/2010 Parmeter et al.
7,828,058 B2 11/2010 Fielder
8,322,444 B2 12/2012 De Camargo
8,430,649 B2 4/2013 Albers et al.
8,471,551 B2 6/2013 Lake et al.
8,651,837 B2 2/2014 Tetzlaff
8,932,034 B2 * 1/2015 McKinney ..... E21B 43/128 166/105
9,631,725 B2 * 4/2017 Semple ..... F16J 15/00
2006/0157240 A1 7/2006 Shaw et al.
2007/0177998 A1 * 8/2007 Kato ..... F04B 7/02 417/395
2008/0257548 A1 * 10/2008 Shaw ..... E21B 34/10 166/255.1
2013/0004344 A1 1/2013 McKinney et al.
2013/0272898 A1 10/2013 Toh et al.
2014/0360360 A1 * 12/2014 Bauer ..... F15B 1/24 92/5 R
2015/0316162 A1 * 11/2015 Ottestad ..... F04B 47/06 137/488
2015/0354328 A1 * 12/2015 Jenisch ..... E21B 43/128 166/105.5

* cited by examiner

METAL BELLOWS EQUALIZER CAPACITY MONITORING SYSTEM

BACKGROUND OF THE INVENTION

1. Field of the Invention

The invention relates generally to seal sections and/or equalizers used in electric submersible pump assemblies used for hydrocarbon production recovery. In particular aspects, the invention relates to systems and methods for measuring or estimating the volume of motor oil contained within a seal section or equalizer.

2. Description of the Related Art

A typical electrical submersible pump (ESP) system includes a pump that is driven by a motor. Because the ESP system may be disposed at great depths and are inaccessible at this time, the motors are designed to operate for a long period of time without maintenance. Motor oil is used to help lubricate the motor and to dissipate the heat the motor generates during operation. The volumetric expansion and contraction of the di-electric motor oil is compensated for by dynamic members in the seal section such as elastomeric bags or metal bellows. Metal bellows are accordion-like structures that expand and contract axially.

SUMMARY OF THE INVENTION

The present invention provides systems and methods for measuring or estimating the volume of fresh motor oil that is contained within a bellows assembly within a seal section or equalizer. Exemplary bellows assemblies are described that are axially expandable and contractible within an outer housing between a fully contracted position and a fully expanded position. The bellows assembly holds a known amount of fluid. The axial position of the bellows assembly with respect to its surrounding housing can be correlated to the volume of fluid that is retained within the bellows assembly. Therefore, as the axial position of the bellows assembly changes during operation, the corresponding change in fluid volume can be derived. Also, while the di-electric oil volume can be derived or estimated using bellows position measurement, the bellows position is important information independently. Information about bellows position within the outer housing permits an operator to know when there is insufficient bellows capacity for further oil expansion or contraction without damage to the bellows assembly.

In a first described embodiment, a linear potentiometer is used to detect the axial position of the bellows assembly within the housing.

In an alternative embodiment, a magnetic driver is mounted on or incorporated into the bellows. A plurality of metallic followers are incorporated into the surrounding housing. As the driver moves proximate a particular follower, the follower provides a signal indicative of the axial position of the driver.

BRIEF DESCRIPTION OF THE DRAWINGS

For a thorough understanding of the present invention, reference is made to the following detailed description of the preferred embodiments, taken in conjunction with the accompanying drawings, wherein like reference numerals designate like or similar elements throughout the several figures of the drawings and wherein.

DETAILED DESCRIPTION OF THE PREFERRED EMBODIMENTS

Figure 1:
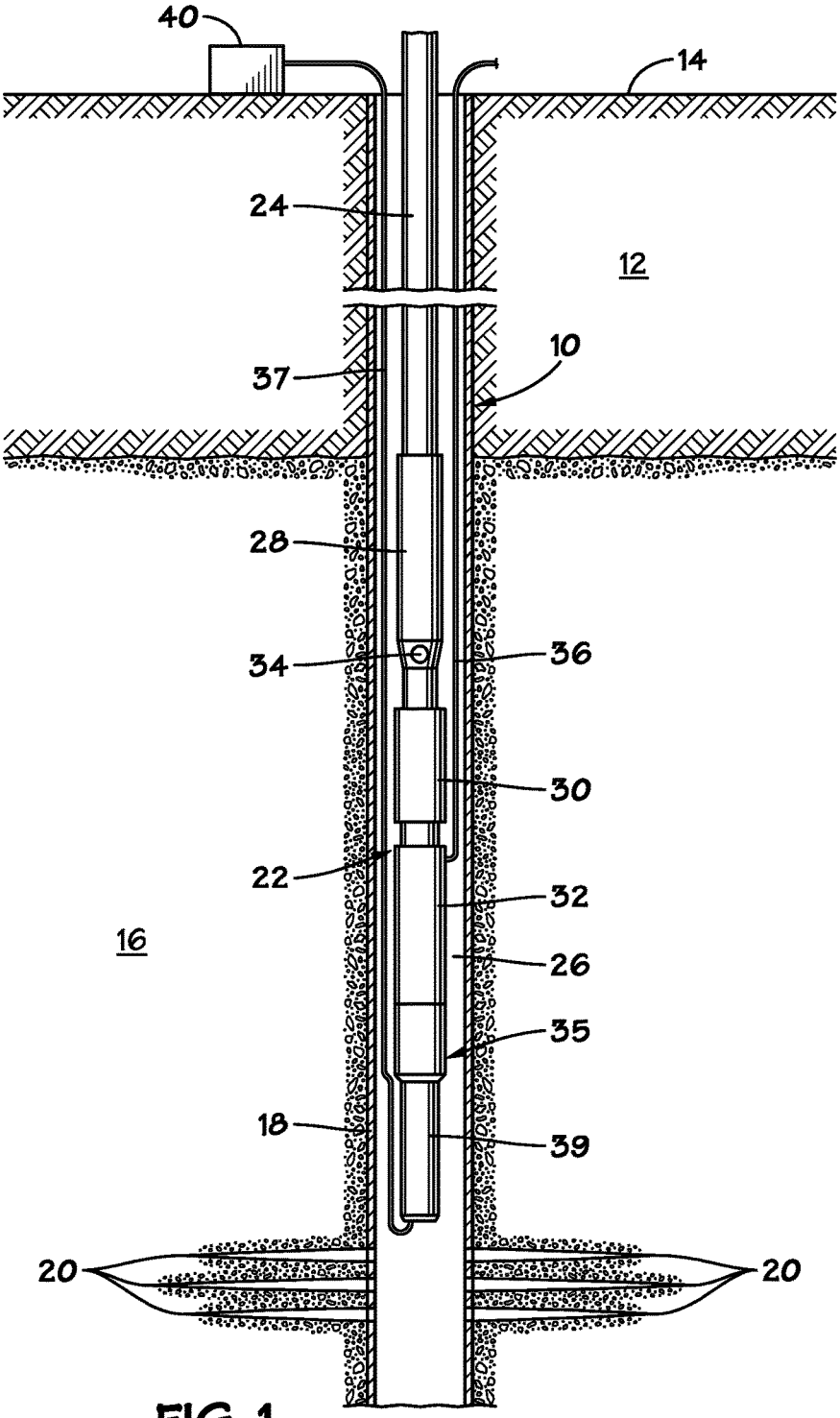
FIG. 1 is a side view of an exemplary electric submersible pump assembly located within a wellbore.

FIG. 1 illustrates an exemplary wellbore 10 that has been drilled through the earth 12 from the surface 14 down to a hydrocarbon-bearing formation 16. The wellbore 10 has been lined with metallic casing 18 of a type known in the art. Perforations 20 are disposed through the casing and into the formation 16, thereby allowing hydrocarbons to enter the wellbore 10.

An electric submersible pump (ESP) assembly, generally indicated at 22, is shown disposed within the wellbore 10 by production tubing 24, which could be traditional jointed pipe or possibly coiled tubing. An annulus 26 is defined between the casing 18 and the running string 24/ESP 22. The ESP assembly 22 includes a pump section 28, a seal section 30 and motor section 32 as well as a below-motor equalizer 35 and affixed gage unit 39. As is known, the motor section 32 drives the pump section 28 to draw hydrocarbon fluid in from the wellbore 10 via fluid inlets 34 and flow it to the surface 14. A power cable 36 provides power to the motor section 32 from the surface 14. As is known, the motor section 32 includes an outer housing, a stator and a rotor that is rotatable with respect to the stator. The rotor rotates a shaft that will, in turn, power the pump section 28. A data communications cable 37 extends from the gage unit 39 to a receiver 40 located at the surface 14.

Figure 2:
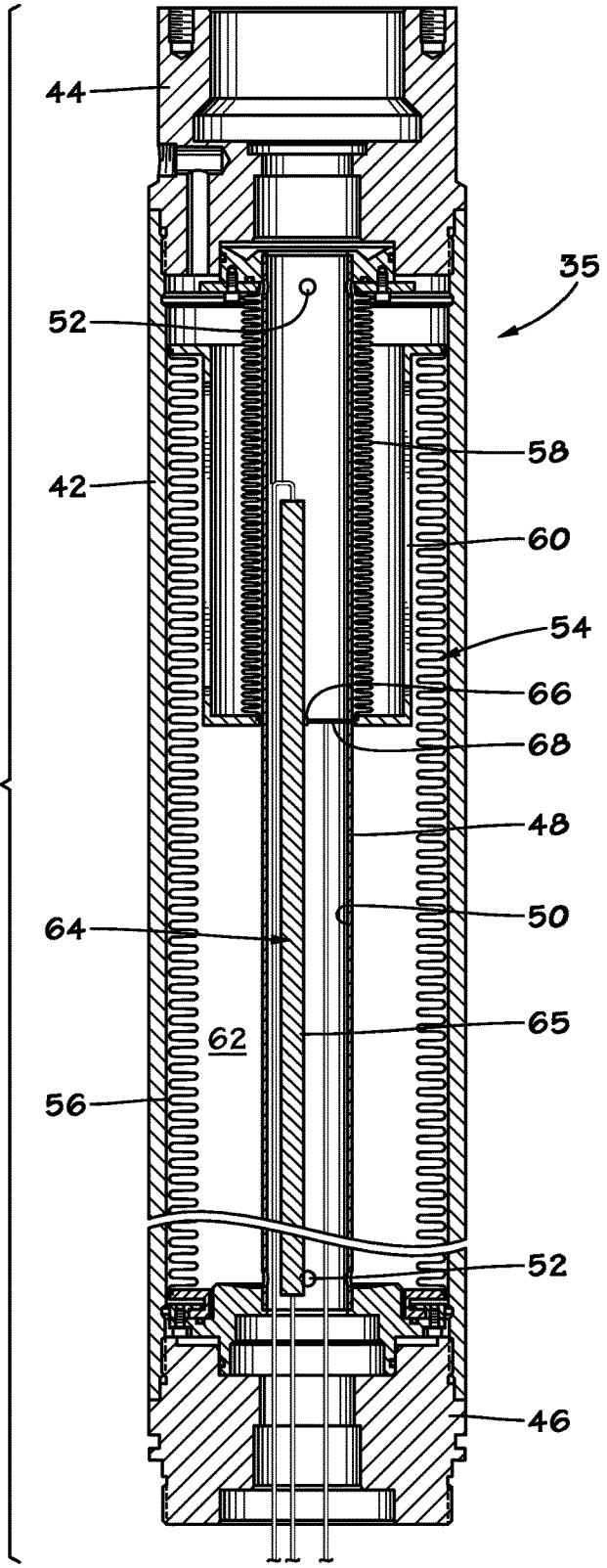
FIG. 2 is a side, cross-sectional view of portions of an exemplary seal section/equalizer which incorporates a bellows assembly and a bellows capacity monitor in accordance with the present invention.

FIG. 2 is a cross-sectional view of portions of the interior of the motor equalizer 35 which incorporates a bellows position monitoring assembly in accordance with the present invention. The equalizer 35 includes a tubular outer housing 42 with a top cap 44 and a bottom cap 46 that are adapted to be interconnected with other ESP components, such as the motor section 32 and gage unit 39. A guide tube 48 extends axially through the center of the housing 42. A guide tube bore 50 is defined within the guide tube 48. Lateral ports 52 are disposed through the guide tube 48 and permit fluid to be transmitted between the guide tube bore 50 and the radial exterior of the guide tube 48.

Figure 3:
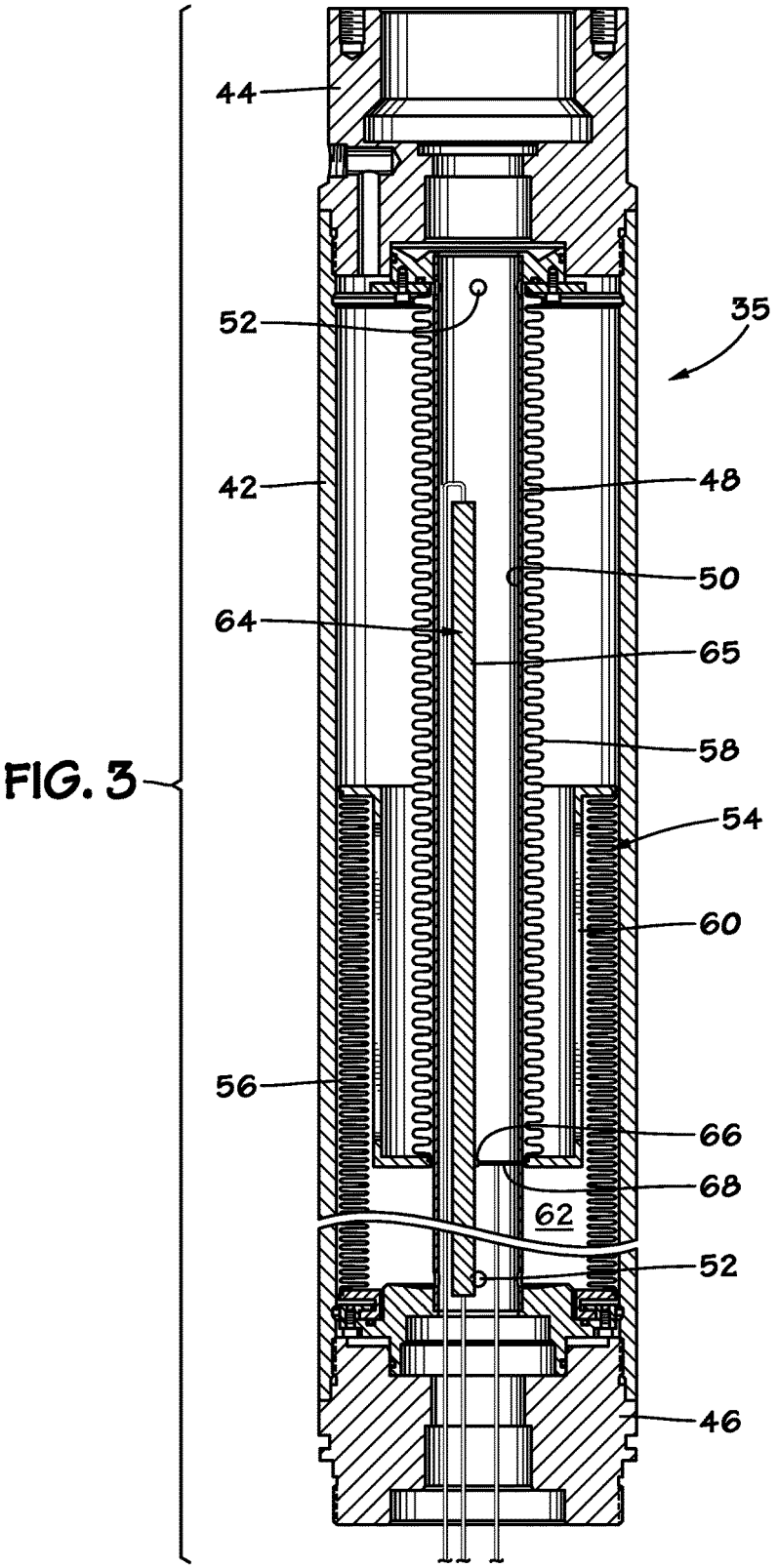
FIG. 3 is a side, cross-sectional view of the seal section/equalizer portions shown in FIG. 2, now with the bellows assembly substantially contracted.

A bellows assembly, generally indicated at 54, is also retained within the outer housing 42 to equalize the pressure of the di-electric motor oil and surrounding wellbore pressure. Bellows assembly 54 includes a radially outer bellows 56 and a radially inner bellows 58. Each of the outer and inner bellows 56, 58 are axially expandable and contractible in the manner of an accordion bellows. The inner and outer bellows 58, 56 are secured together by an annular sleeve 60. The outer bellows 56 lies just radially within the outer housing 42 while the inner bellows 58 lies just radially outside of the guide tube 48. The bellows assembly 54 encloses a volume of motor oil in the region 62 lying between the inner and outer bellows 58, 56. In FIG. 2, the bellows assembly 54 is shown in an expanded condition wherein the bellows assembly 54 contains a large amount of motor oil. FIG. 3 shows the bellows assembly 54 in a contracted condition wherein the bellows assembly 54 contains a lesser amount of motor oil.

A linear potentiometer 64 is disposed within the guide tube bore 50 and is employed as a bellows position monitoring arrangement. The potentiometer 64 provides a sliding contact 66 that can be moved along the length of the potentiometer body 65 to change resistance provided across the potentiometer 64. A connection 68 is provided between the sliding contact 66 and the sleeve 60 of the bellows assembly 54. In currently preferred embodiments, the connection 68 is a rigid connection between the sleeve 60 and the contact 66, such as an arm, rod or bar, so that the sleeve 60 and contact 66 move together. A longitudinal slot (not shown) is formed in the guide tube 48 that permits the connection 68 to interconnect the sliding contact 66 within the guide tube bore 50 with the sleeve 60 outside of the guide tube 48 and along which the connection 68 will move as the bellows assembly 54 expands or contracts. It is noted that, while the sliding contact 66 is shown to be connected with the sleeve 60 of the bellows assembly 54, it might instead be interconnected with other portions of the bellows assembly 54, such as the inner bellows 58. As di-electric motor oil within the bellows assembly 54 expands and contracts due to changes in temperature and pressure, the bellows assembly 54 moves within the outer housing 42 from an expanded condition (FIG. 2) to a contracted condition (FIG. 3). Resistance across the potentiometer 64 will change as the contact 66 is moved along its body. A signal indicative of the change in resistance is transmitted to the gage unit 39. Optionally, data and information from the gage unit 39 can be transmitted to the receiver 40 at surface 14 via the data communications cable 38.

An operator can use the signal indicative of the change in resistance to determine an approximate volume of motor oil remaining in the region 62. One technique for determining the approximate volume of remaining fluid is to directly measure this at surface and correlate remaining volume with potentiometer resistance. At surface and prior to running the equalizer 35 into the wellbore 10, the region 62 of the bellows assembly 54 is filled to capacity with a measured amount of fluid. The resistance across the potentiometer 64 is measured. Thereafter, the fluid is drained from the region 62 while resistance measurements are recorded at increments of draining. The detected measurements are correlated with the volume of fluid then remaining in the bellows assembly 54. These measurements can then be used to determine an approximate amount of fluid remaining within the bellows assembly 54.

Figure 4:
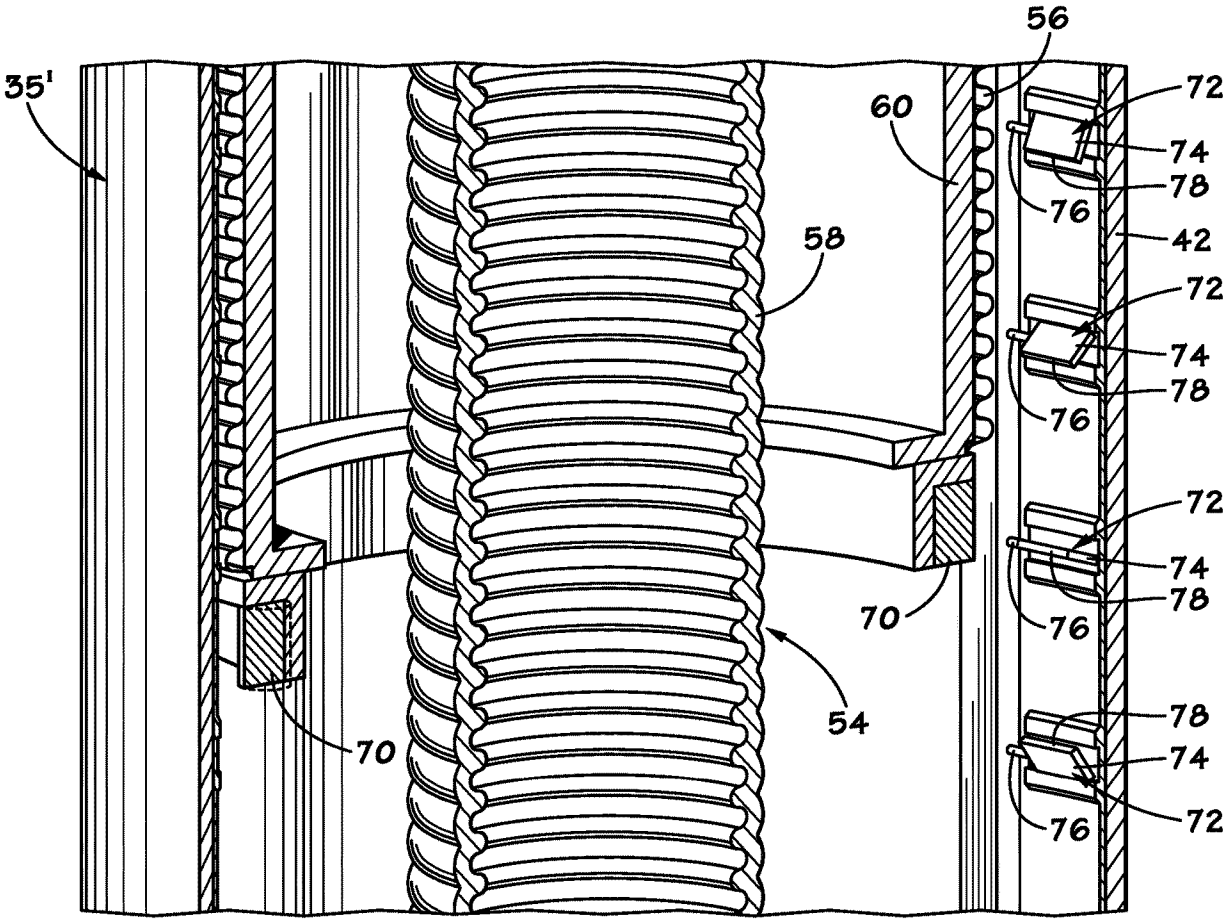
FIG. 4 is a side, cutaway view of portions of an exemplary seal section/equalizer which incorporates an alternative type of bellows capacity monitor.

FIG. 4 illustrates an alternative bellows position monitoring arrangement that can be used within equalizer 35'. In FIG. 4, the guide tube 50 is not shown. The bellows position monitoring system includes a cylindrical magnetic driver 70 that is operably associated with the bellows assembly 54 so that the magnetic driver 70 is moved axially within the housing 42 as the bellows assembly 54 expends or contracts within the housing 42. In the depicted embodiment, the magnetic driver 70 is a cylindrical magnet that is secured to the lower end of the sleeve 60. However, it might be incorporated into or affixed to other portions of the bellows assembly 54. The bellows position monitoring system also includes a pluralities of monitoring followers 72 that are incorporated into or onto the outer housing 42. The monitoring followers 72 are adapted to move or be triggered by the magnetic driver 70. In the depicted embodiment, the monitoring followers 72 paddle-shaped members 74 that are rotatably supported upon shafts 76. One edge portion 78 of each paddle-shaped member 74 is made of a metal that is strongly magnetically attracted to the magnetic driver 70. As the driver 70 moves axially within the housing 42 (as motor oil is expended from within the bellows assembly 54), the monitoring followers 72 will rotate in concert with this movement. Rotation of the shafts 76 can be measured using a potentiometer or with other means known in the art. The measured rotation of monitoring followers 72 can provide an indication of the axial position of the bellows assembly 54 within the housing 42.

It is noted that in accordance with the present invention, other mechanisms might be used to detect or determine the linear position of the bellows assembly 54 or its displacement. Such mechanisms include a fiber optic detection arrangement or a linear variable differential transformer.

Those of skill in the art will recognize that numerous modifications and changes may be made to the exemplary designs and embodiments described herein and that the invention is limited only by the claims that follow and any equivalents thereof.

What is claimed is:

1. An equalizer for an electric submersible pump comprising:

an outer housing;

a bellows assembly that retains an amount of fluid, the bellows assembly being axially moveable between an expanded position and a contracted position as fluid expands or contracts within the bellows assembly;

a bellows assembly position monitoring arrangement operably associated with the equalizer for determining an axial position of the bellows assembly within the outer housing and determining a bellows assembly fluid capacity based upon the axial position;

wherein the bellows position monitoring arrangement further comprises a magnetic driver operably associated with the bellows assembly and axially moveable within the outer housing as the bellows assembly expands and contracts within the housing, and at least one monitoring follower operably associated with the housing, the at least one follower being magnetically responsive to the magnetic driver as the magnetic driver is moved within the outer housing; and one or more of the at least one monitoring follower further comprises a member that is rotatable upon a shaft, the member having an edge portion that is magnetically attracted to the magnetic follower so that the member is rotated upon the shaft as the magnetic driver is moved within the outer housing.

2. The equalizer of claim 1 wherein the magnetic driver further comprises a cylindrical magnet.

3. The equalizer of claim 2 wherein:

the bellows assembly comprises an inner bellows and an outer bellows radially surrounding the inner bellows and an annular sleeve which secures the inner and outer bellows together; and wherein the cylindrical magnet is incorporated into the annular sleeve.

4. An equalizer for an electric submersible pump comprising:

an outer housing;

a bellows assembly that retains an amount of fluid, the bellows assembly being axially moveable between an expanded position and a contracted position as fluid expands or contracts within the bellows assembly;

the bellows assembly having an inner bellows and an outer bellows radially surrounding the inner bellows;

a bellows assembly position monitoring arrangement operably associated with the equalizer for determining an axial position of the bellows assembly within the outer housing and determining a bellows assembly fluid capacity based upon the axial position;

a magnetic driver operably associated with the bellows assembly and axially moveable within the outer housing as the bellows assembly expands and contracts within the housing;

at least one monitoring follower operably associated with the housing, the at least one follower being magnetically responsive to the magnetic driver as the magnetic driver is moved within the outer housing; and one or more of the at least one monitoring follower further comprises a member that is rotatable upon a shaft, the member having an edge portion that is magnetically attracted to the magnetic follower so that the member is rotated upon the shaft as the magnetic driver is moved within the outer housing.

5. The equalizer of claim 4 wherein the magnetic driver further comprises a cylindrical magnet.

6. The equalizer of claim 5 wherein:

the bellows assembly further comprises an annular sleeve which secures the inner and outer bellows together; and the cylindrical magnet is incorporated into the annular sleeve.

7. An equalizer for an electric submersible pump comprising:

an outer housing;

a bellows assembly that retains an amount of fluid, the bellows assembly being axially moveable between an expanded position and a contracted position as fluid expands or contracts within the bellows assembly;

the bellows assembly having an inner bellows and an outer bellows radially surrounding the inner bellows and an annular sleeve which secures the inner and outer bellows together;

a bellows assembly position monitoring arrangement operably associated with the equalizer for determining an axial position of the bellows assembly within the outer housing and determining a bellows assembly fluid capacity based upon the axial position;

a magnetic driver operably associated with the bellows assembly and axially moveable within the outer housing as the bellows assembly expands and contracts within the housing;

at least one monitoring follower operably associated with the housing, the at least one follower being magnetically responsive to the magnetic driver as the magnetic driver is moved within the outer housing; and one or more of the at least one monitoring follower further comprises a member that is rotatable upon a shaft, the member having an edge portion that is magnetically attracted to the magnetic follower so that the member is rotated upon the shaft as the magnetic driver is moved within the outer housing.

8. The equalizer of claim 7 wherein the magnetic driver further comprises a cylindrical magnet.

* * * * *